US010276110B2

(12) United States Patent
Chen et al.

(10) Patent No.: US 10,276,110 B2
(45) Date of Patent: Apr. 30, 2019

(54) LIQUID CRYSTAL PANEL DRIVER AND METHOD FOR DRIVING THE SAME

(71) Applicant: Shenzhen China Star Optoelectronics Technology Co., Ltd., Shenzhen, Guangdong (CN)

(72) Inventors: Yin-hung Chen, Guangdong (CN); Yu Wu, Guangdong (CN); Anle Hu, Guangdong (CN)

(73) Assignee: Shenzhen China Start Optoelectronics Technology Co., Ltd, Shenzhen, Guangdong (CN)

( * ) Notice: Subject to any disclaimer, the term of this patent is extended or adjusted under 35 U.S.C. 154(b) by 299 days.

(21) Appl. No.: 15/125,155

(22) PCT Filed: May 26, 2016

(86) PCT No.: PCT/CN2016/083500

§ 371 (c)(1),
(2) Date: Sep. 10, 2016

(87) PCT Pub. No.: WO2017/173720

PCT Pub. Date: Oct. 12, 2017

(65) Prior Publication Data

US 2018/0174531 A1 Jun. 21, 2018

(30) Foreign Application Priority Data

Apr. 8, 2016 (CN) ..... 2016 1 0217069

(51) Int. Cl.
*G09G 3/36* (2006.01)

(52) U.S. Cl.
CPC ..... *G09G 3/36* (2013.01); *G09G 3/3611* (2013.01); *G09G 3/3648* (2013.01);
(Continued)

(58) Field of Classification Search
CPC ..... G09G 3/36; G09G 3/02; G09G 3/3648; G09G 3/3688; G09G 2320/02;
(Continued)

(56) References Cited

U.S. PATENT DOCUMENTS 7,830,371 B2 11/2010 Song
2011/0157148 A1* 6/2011 Jang ..... G09G 3/3677 345/213

(Continued)

FOREIGN PATENT DOCUMENTS

CN 1928682 A 3/2007
CN 101187743 A 5/2008

(Continued)

*Primary Examiner* — Jennifer T Nguyen
(74) *Attorney, Agent, or Firm* — Andrew C. Cheng

(57) ABSTRACT

A liquid crystal panel driver includes a signal controller to generate pixel clock signals and adjust duty cycle of the pixel clock signals, and a gate driver to receive the pixel clock signal of an adjusted duty cycle and a preset gate turn-on voltage provided by an external signal source, and calculate the actual gate turn-on voltage provided to the gate lines based on the pixel clock signal of the adjusted duty cycle and the preset gate turn-on voltage. The present disclosure also proposes a method for driving drivers of a liquid crystal display, the drivers comprising a signal controller and gate drivers. The liquid crystal panel driver and the method to ensure that each gate driver outputs an identical gate turn-on voltage VGH, therefore areas driven by each gate drivers have the same actual charging time, which elevates the display quality of an LCD.

4 Claims, 3 Drawing Sheets

(52) U.S. Cl.
CPC ..... *G09G 3/3674* (2013.01); *G09G 3/3688* (2013.01); *G09G 2310/06* (2013.01); *G09G 2310/08* (2013.01); *G09G 2320/02* (2013.01); *G09G 2370/08* (2013.01)

(58) Field of Classification Search
CPC .. G09G 2310/06; G09G 2310/08; G09G 3/00; G09G 2310/027; G09G 2310/0264
USPC ..... 345/87–100, 204
See application file for complete search history.

(56) References Cited

U.S. PATENT DOCUMENTS

2011/0273408 A1* 11/2011 Ra ..... G09G 3/3266 345/204
2014/0152629 A1* 6/2014 So ..... G11C 19/28 345/205
2015/0091783 A1* 4/2015 Hwang ..... G09G 3/20 345/55

FOREIGN PATENT DOCUMENTS

KR 10-0537886 B1 12/2005
TW 493149 B 7/2002

* cited by examiner

LIQUID CRYSTAL PANEL DRIVER AND METHOD FOR DRIVING THE SAME

BACKGROUND OF THE INVENTION

1. Field of the Invention

The present invention relates to the field of driver circuit technology, and more specifically, to a liquid crystal panel driver and method for driving the driver.

2. Description of the Prior Art

Evolving photoelectric and semi-conductor technology spurs prosperous developments in flat panel display. Among a variety of flat penal displays, liquid crystal display (LCD) has been applied to all aspects of industrial production and people's daily life as it has many outstanding features, including high space efficiency, low energy consumption, no radiation and low electromagnetic interference.

Presently, LCD is developing to become larger and have higher resolution, so a plurality of gate drivers is deployed on one side or both sides of the liquid crystal panel. However, given that a trace area on the liquid crystal panel is narrow, wires on array (WOA) are longer and the impedance is higher. Therefore, a turn-on voltage (i.e. the high voltage, VGH) provided to gate drivers deteriorates. Because there is a big difference between the actual VGH received by each gate driver at different positions, areas driven by neighboring gate drives have different actual charging time. Thus areas driven by neighboring gate drivers see horizontal domain defects, which seriously affect the display quality of a LCD.

SUMMARY OF THE INVENTION

According to the present invention, a liquid crystal panel driver includes: a signal controller, configured to generate pixel clock signals and adjust duty cycle of the pixel clock signals; and a gate driver, configured to receive the pixel clock signal of an adjusted duty cycle and a preset gate turn-on voltage provided by an external signal source, and calculate the actual gate turn-on voltage provided to the gate lines based on the pixel clock signal of the adjusted duty cycle and the preset gate turn-on voltage.

Furthermore, the number of the gate drivers is N. The duty cycle provided by the signal controller to the gate drivers, from the first to the Nth, increases linearly when the gate drivers, from the first to the Nth, are arranged along the direction away from the signal controller, thus the actual gate turn-on voltage calculated by each gate driver based on the corresponding pixel clock signal and the base gate turn-on signal is the same.

Furthermore, each gate driver provides the calculated actual gate turn-on voltage to m gate lines. The signal controller comprises: a generating unit configured to generate pixel clock signals, a counting unit configured to generate a counting is signal when the number counted is a natural multiple of m, a duty cycle adjusting unit, configured to receive the counting signal and adjust the duty cycle of the pixel clock signal accordingly, and a first output unit configured to output the pixel clock signal of an adjusted duty cycle to the corresponding gate driver.

Furthermore, each gate driver comprises: a detecting unit, configured to detect the duration of the high level of the received pixel clock signal and the interval of the high level of two neighboring pixel clock signals; a calculating unit, configured to calculate the actual gate turn-on voltage based on the duration of the high level of the received pixel clock signal, time interval, the preset gate turn-on voltage and a time limit of the duration of the high level of the pixel clock signal; a second output unit, configured to output the calculated actual gate turn-on voltage to m corresponding gate lines.

Furthermore, the calculating unit calculates the actual gate turn-on voltage based on the duration of the high level of the received pixel clock signal, time interval, the preset gate turn-on voltage and a time limit of the duration of the high level of the pixel clock signal by the following Formula 1, $$VGH=K\times(Tr-T0)/\Delta t+V0,$$

where VGH stands for the actual gate turn-on voltage, Tr stands for the duration of the high level of the received pixel clock signal, T0 stands for the time limit of the duration of the high level of the pixel clock signal, Δt stands for time interval, and V0 stands for the preset gate turn-on voltage.

According to the present invention, a method for driving drivers of a liquid crystal display is proposed. The drivers include a signal controller and gate drivers is provided. The method comprises: generating pixel clock signals with the signal controller and adjusting the duty cycle of the pixel clock signals; and calculating an actual gate turn-on voltage provided to gate lines with the gate drivers based on a pixel clock signal of an adjusted duty cycle and a preset gate turn-on voltage provided by an external signal source.

Furthermore, each gate driver provides the calculated actual gate turn-on voltage to m gate lines. The signal controller comprises a generating unit, a counting unit, a duty cycle adjusting unit, and a first output unit. The step of generating pixel clock signals with the signal controller and adjusting the duty cycle is of the pixel clock signals further comprises: generating pixel clock signals with the generating unit; generating, with the counting unit, a counting signal when the number counted is a natural multiple of m; receiving the counting signal and adjusting the duty cycle of the pixel clock signal with the duty cycle adjusting unit; and outputting the pixel clock signal of an adjusted duty cycle to the corresponding gate driver with the first output unit.

Furthermore, each gate driver comprises a detecting unit, a calculating unit, and a second output unit. A step of calculating the actual gate turn-on voltage provided to gate lines with the gate drivers based on the pixel clock signal of the adjusted duty cycle and the preset gate turn-on voltage provided by the external signal source, comprises: detecting, with the detecting unit, the duration of the high level of the received pixel clock signal and the interval of the high level of two neighboring pixel clock signals; calculating, with the calculating unit, the actual gate turn-on voltage based on the duration of the high level of the received pixel clock signal, the time interval, the preset gate turn-on voltage and a time limit of the duration of the high level of the pixel clock signal; outputting, with the second output unit, the calculated actual gate turn-on voltage to the m corresponding gate lines.

The liquid crystal panel driver and method for driving the same of the present invention ensures that each gate driver outputs an identical gate turn-on voltage VGH, therefore areas driven by each gate drivers have the same actual charging time, which elevates the display quality of an LCD.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF THE PREFERRED EMBODIMENTS

Embodiments of the present invention are described in detail with the technical matters, structural features, achieved objects, and effects with reference to the accompanying drawings as follows. Specifically, the terminologies in the embodiments of the present invention are merely for describing the purpose of the certain embodiment, but not to limit the invention.

Figure 1:
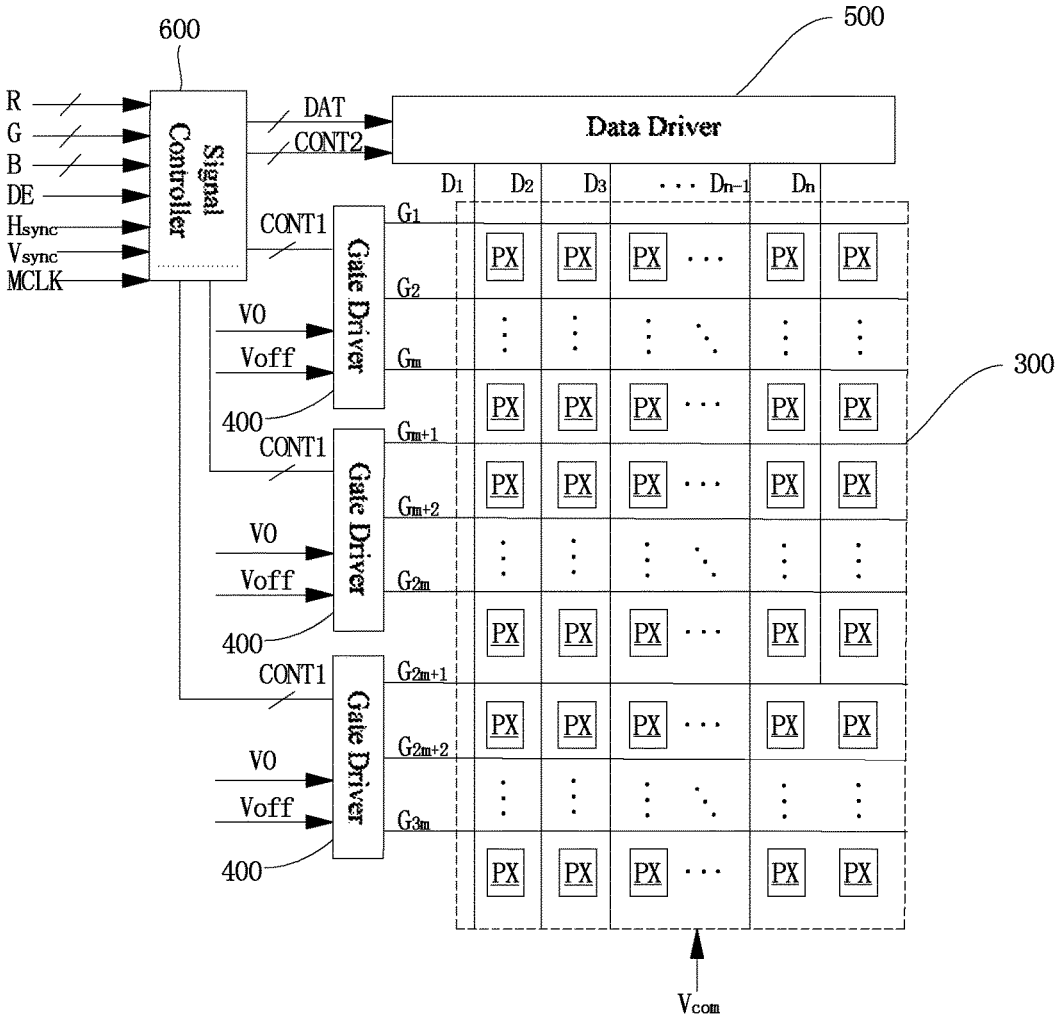
FIG. 1 shows a block diagram of an LCD according to an embodiment of the present invention.

FIG. 1 shows a block diagram of an LCD according to an embodiment of the present invention.

The LCD of the present embodiment of the present invention shown in FIG. 1 comprises a liquid crystal panel component 300; gate drivers 400 and a data driver 500, both connected to the liquid crystal panel component 300; a signal controller 600 to control the liquid crystal panel component 300, gate drivers 400 and data driver 500.

The liquid crystal panel component 300 comprises a plurality of display signal lines and pixels PX, arranged in an array and connected to the display signal lines. The liquid crystal panel component 300 can comprise a bottom display panel (not shown in FIG. 1), a top display panel (not show in the FIG. 1), and a liquid crystal layer inserted between the bottom display panel and top display panel (not shown in FIG. 1).

Display signal lines can be deployed on the bottom display panel. Display signal lines can comprise a plurality of gate lines $G_1$ to $G_{3m}$ that send gate signals and a plurality of data lines $D_1$ to $D_n$ that send data signals. The gate lines $G_1$ to $G_{3m}$ extend horizontally and generally parallel to each other, while the data lines $D_1$ to is $D_n$ extend vertically and generally parallel to each other.

Each pixel PX comprises a switch elements connected to corresponding gate lines and data lines, and a liquid crystal capacitor connected to the switch elements. When necessary, each pixel PX can comprise a storage capacitor connected to the liquid crystal capacitor.

The switch elements of each pixel PX has three terminals: a control terminal connected to the corresponding gate line, an input terminal connected to the corresponding data line, and an output terminal connected to the corresponding liquid crystal capacitor.

The gate drivers 400 connect and send gate signals to gate lines $G_1$ to $G_{3m}$. The gate signal is a combination of a high level gate signal (hereinafter refers to as a preset gate turn-on voltage V0) and a low level gate signal (hereinafter refers to as a gate turn-off voltage Voff) provided by an external source to the gate drivers 400. FIG. 1 shows that three gate drivers 400 are deployed on one side of the liquid crystal component 300. These three gate drivers 400 are deployed along the direction away from the signal controller 600. The gate driver 400 closest to the signal controller 600 is defined as the first gate driver 400, the gate driver 400 farest away from the signal controller 600 is defined as the third gate driver 400, and the gate driver 400 disposed between the first and the third gate drivers 400 is defined as the second gate driver 400. Note that the number of gate drivers 400 in the present invention is not limited to three; it can be configured based on the actual situation.

Gate lines $G_1$ to $G_{3m}$ connect to the gate drivers 400. More specifically, gate lines $G_1$ to $G_m$ connect to the first gate driver 400, gate lines $G_{m+1}$ to $G_{2m}$ connect to the second gate driver 400, and gate lines $G_{2m+1}$ to $G_{3m}$ connect to the third gate driver 400.

Another embodiment of the present invention deploys three gate drivers respectively on two opposite sides of the liquid crystal panel component 300. The gate lines $G_1$ to $G_m$, $G_{m+1}$ to $G_{2m}$, and $G_{2m+1}$ to $G_{3m}$ connect, respectively, to each of the two gate drivers disposed opposite to each other.

The gate driver 500 connects to the data lines $D_1$ to $D_n$ of the liquid crystal component 300, and sends a data voltage to the pixels PX. The signal controller 600 is controls the operation of the gate drivers 400 and the data driver 500.

The signal controller 600 receives inputted graphical signals (R, G, B) from an external graphic controller (not shown in FIG. 1) and a plurality of inputted control signals, such as a vertical synchronization signal Vsync, a horizontal synchronization signal Hsync, a main clock signal MCLK, and a data enabling signal DE, to control the display of inputted graphical signals. The signal controller 600, based on the inputted control signal, appropriately treats the inputted graphical signals (R, G, B), and thus generates graphical data DAT which meets the operating criteria of the liquid crystal panel component 300. Then, the signal controller 600 generates a gate control signal CONT1 and data control signal CONT2, and sends the gate control signal CONT1 to each gate driver 400, and the data control signal CONT2 and graphical data DAT to the data driver 500.

The gate control signal CONT1 can comprise a scan starting signal STV to start the operation—scanning—of the gate drivers 400; and one or more pixel clock signals CKV to control the timing of the output of the actual gate turn-on voltage VGH. The gate control signal CONT1 can also comprise an output enable signal OE to limit the duration of the actual gate turn-on voltage VGH. Furthermore, the duty cycle of the pixel clock signal CKV provided by the signal controller 600 is adjustable. More specifically, the duty cycle of the pixel clock signal CKV provided by the signal controller 600 to the first gate driver 400 to the third gate driver 400 increases linearly.

In response to the gate control signal CONT1, the three gate drivers 400 supply the actual gate turn-on voltage VGH through the gate lines $G_1$ to $G_{3m}$ to turn on the switch elements connected to the gate lines $G_1$ to $G_{3m}$. More specifically, the actual gate turn-on voltage VGH of each gate driver 400 is calculated based on the received preset gate turn-on voltage V0 and the pixel clock signal CKV of an adjusted duty cycle. Given that the duty cycle of the pixel clock signal CKV that the signal controller 600 provides to the first gate driver 400 to the third gate driver 400 increases linearly, the actual gate turn-on voltage VGH sends to the gate lines $G_1$ to $G_{3m}$ by the first gate driver 400 to the third gate driver 400 is the same.

The data control signal CONT2 can comprise a horizontal synchronization start signal STH that indicates the transmission of the graphical data DAT; a load signal is LOAD that requests the sending of a data voltage corresponded to the graphical data DAT to the data lines $D_1$ to $D_n$; and a data clock signal HCLK. The data control signal CONT2 can also comprise a reverse signal RVS to reverse the polarity of the data voltage as opposite to a common voltage Vcom, hereinafter referred to as "the polarity of the data voltage."

The data driver 500 responds to the data control signal CONT2 and receives graphical data DAT from the signal controller 600, and chooses a gray-scale voltage corresponded to the graphical data DAT and turns the graphical data into a data voltage. Then, the data driver 500 provides the data voltage to the data lines $D_1$ to $D_n$.

After the three gate drivers 400 turn on the switch elements connected to the gate lines $G_1$ to $G_{3m}$ by responding to the gate control signal CONT1 and sending the actual gate turn-on voltage VGH to gate lines $G_1$ to $G_{3m}$, the data voltage sent to the data lines $D_1$ to $D_n$ is transmitted to each pixel PX through the switch elements that is turned on.

An interval between the data voltage provided to each pixel PX and the common voltage Vcom can be explained as a utilization of a voltage charging a liquid crystal capacitor of each pixel PX, i.e. the pixel voltage. The arrangement of liquid crystal molecules in the liquid crystal layer changes according to the margin of the pixel voltage. Thus the polarity of the light transmitted through the liquid crystal layer can also be changed, which leads to changes in transmittance of the liquid crystal layer.

The following text explains the signal controller 600 and each gate driver 400 of the embodiment of the present invention.

Figure 2:
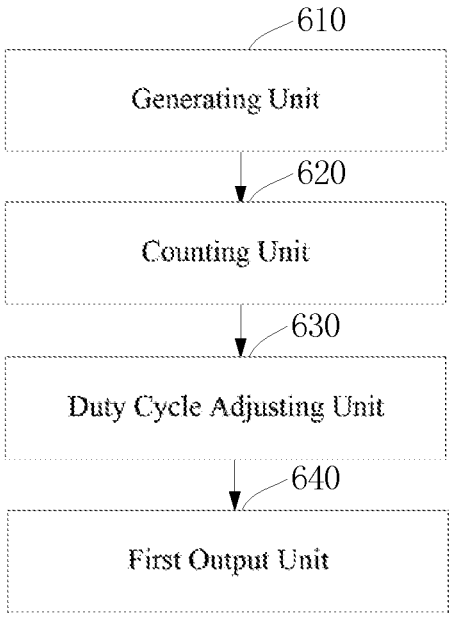
FIG. 2 shows a block diagram of the signal controller according to the embodiment of the present invention.
Figure 3:
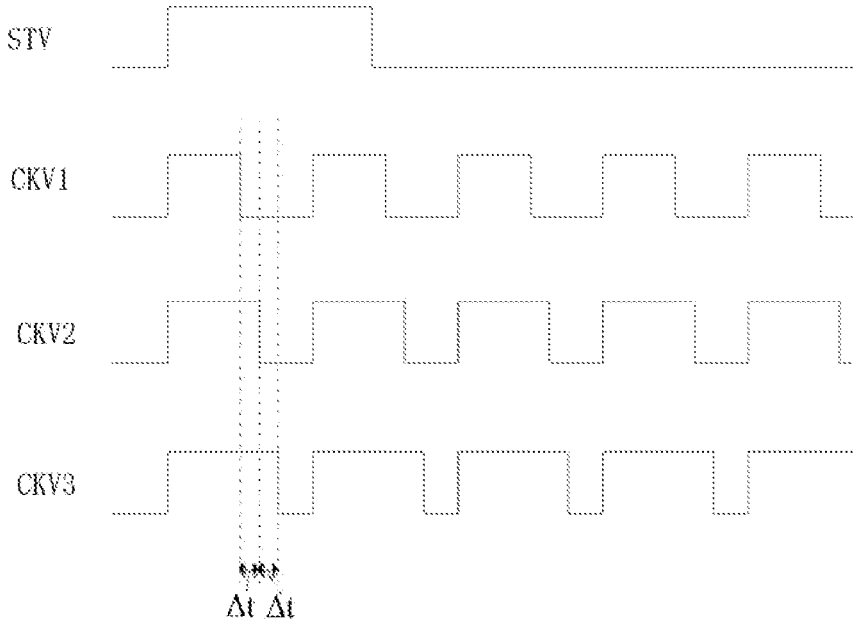
FIG. 3 shows waveforms of the scan starting signal and each pixel clock signal provided by the signal controller of the embodiment of the present invention.

FIG. 2 shows a block diagram of the signal controller of the embodiment of the present invention. FIG. 3 shows waveforms of the scan starting signal and each pixel clock signal provided by the signal controller of the embodiment of the present invention.

Please refer to FIG. 2 and. FIG. 3. The signal controller 600 of the embodiment of the present invention comprises a generating unit 610 to generate pixel clock signals CKV; a counting unit 620 to generate a counting signal when the number counted is a natural multiple of m; a duty cycle adjusting unit 630 to receive the counting is signal and adjust the duty cycle of the pixel clock signals CKV accordingly; and a first output unit 640 to output the pixel clock signal CKV of an adjusted duty cycle to a corresponding gate driver.

More specifically, the generating unit 610 generates a pixel clock signal CKV, which can directly serve as an adjusted pixel clock signal CKV1 provided to the first gate driver 400.

The counting unit 620 counts the number of gate lines driven by the corresponding gate driver 400. When the number counted is a natural multiple of m, the counting unit 620 generates a counting signal.

For example, when the number counted is 0, or m, or 2 m, i.e. 0, or 1, or 2 times of m, the generating unit 620 generates a counting signal respectively.

The duty cycle adjusting unit 630 receives the counting signal and adjusts the duty cycle of the pixel clock signal CKV accordingly. When the number counted received by the duty cycle adjusting unit 630 is 0, the duration of the high level of the pixel clock signal CKV is increased by 0 so to form a first pixel clock signal CKV1. When the number counted received by the duty cycle adjusting unit 630 is m, the duration of the high level of the pixel clock signal CKV is increased by Δt so to form a second pixel clock signal CKV2. When the number counted received by the duty cycle adjusting unit 630 is 2 m, the duration of the high level of the pixel clock signal CKV is increased by 2Δt so to form a third pixel clock signal CKV3.

The first output unit 640 outputs the first pixel clock signal CKV1, the second pixel clock signal CKV2, and the third pixel clock signal CKV3 to the first, second and third gate drivers 400 respectively.

Figure 4:
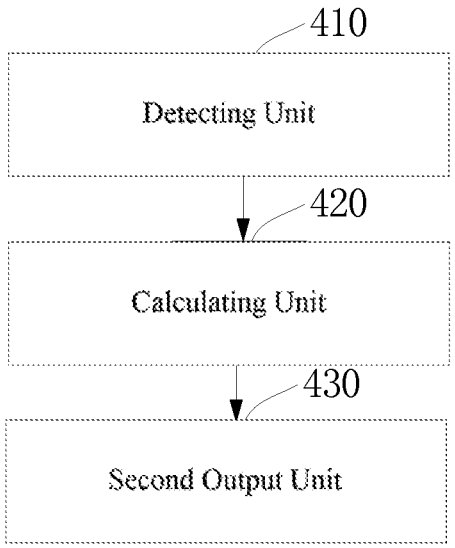
FIG. 4 shows a block diagram of the gate controller according to the embodiment of the present invention.

FIG. 4 shows a block diagram of the gate controller according to the embodiment of the present invention.

Please refer to FIG. 2 to FIG. 4. Each gate driver 400 comprises a detecting unit 410 to detect the duration of the high level of the received pixel clock signal and the interval between the durations of the high level of two neighboring pixel clock signals; a calculating unit 420 to calculate the actual gate turn-on voltage VGH based on the duration of the high level of the received pixel clock signal, time interval, the preset gate turn-on voltage V0 and a time limit of the duration of the is high level of the pixel clock signal; and a second output unit 430 to output the calculated actual gate turn-on voltage VGH to m corresponding gate lines.

More specifically, the calculating unit 420 calculates the actual gate turn-on voltage VGH based on the duration of the high level of the received pixel clock signal, time interval of the high level of two neighboring pixel clock signals, the preset gate turn-on voltage V0 and a time limit of the duration of the high level of the pixel clock signal by the following Formula 1.

$$VGH=K\times(Tr-T0)/\Delta t+V0 \quad \text{[Formula 1]}$$

In Formula 1, VGH stands for the actual gate turn-on voltage; Tr stands for the duration of the high level of the received pixel clock signal; T0 is a fixed number standing for the time limit of the duration of the high level of the pixel clock signal, i.e. the duration of the high level of the pixel clock signal CKV generated by the generating unit 610; Δt stands for time interval; and V0 stands for the preset gate turn-on voltage.

More specifically, when the first output unit 640 outputs the first pixel clock signal CKV1 to the first gate driver 400, the detecting unit 410 detects the duration of the first pixel clock signal CKV1 and time interval of the high level of the first pixel clock signal CKV1 and a neighboring pixel clock signal. The calculating unit 420 calculates the actual gate turn-on voltage VGH based on the duration of the high level of the first pixel clock signal CKV1, time interval of the high level of the first pixel clock signal CKV1 and its neighboring pixel clock signal, the preset gate turn-on voltage V0 and the time limit of the duration of the high level of the pixel clock signal by the abovementioned Formula 1. The second output unit 430 outputs the calculated actual gate turn-on voltage VGH to the gate lines $G_1$ to $G_m$. In the present case, there is no signal for comparison before the first pixel clock signal CKV1 is provided, thus the duration of the high level of the neighboring pixel clock to signals is 0, and time interval of the high level of the first pixel clock signal CKV1 and its neighboring pixel clock signal is the duration of the high level of the first pixel clock signal CKV1. In other words, what the second output 430 outputs to the gate lines $G_1$ to $G_m$ is the preset gate turn-on voltage V0.

When the first output unit 640 outputs the second pixel clock signal CKV2 to is the second gate driver 400, the detecting unit 410 detects the duration of the high level of the second pixel clock signal CKV2, and time interval of the high level of the second pixel clock signal CKV2 and the first pixel clock signal CKV1. The calculating unit 420 calculates the actual gate turn-on voltage VGH based on the duration of the high level of the second pixel clock signal CKV2, time interval of the high level of the second pixel clock signal CKV2 and the first pixel clock signal CKV1, the preset gate turn-on voltage V0 and a time limit of the duration of the high level of the pixel clock signal by the abovementioned Formula 1. The second output unit 430 outputs the calculated actual gate turn-on voltage VGH to the gate lines $G_{m+1}$ to $G_{2m}$.

When the first output unit 640 outputs the third pixel clock signal CKV3 to the second gate driver 400, the detecting unit 410 detects the duration of the high level of the third pixel clock signal CKV3, and time interval of the high level of the third pixel clock signal CKV3 and the second pixel clock signal CKV2. The calculating unit 420 calculates the actual gate turn-on voltage VGH based on the duration of the high level of the third pixel clock signal CKV3, time interval of the high level of the third pixel clock signal CKV3 and the second pixel clock signal CKV2, the preset gate turn-on voltage V0 and a time limit of the duration of the high level of the pixel clock signal by the abovementioned Formula 1. The second output unit 430 outputs the calculated actual gate turn-on voltage VGH to the gate lines $G_{2m+1}$ to $G_{3m}$.

To sum up, in the embodiment of the present invention, the gate turn-on voltages VGH outputted by each gate driver is the same, thus the actual charging time of the areas driven by each gate driver is the same, therefore elevates the display quality of the LCD.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal panel driver, comprising:

a signal controller, configured to generate pixel clock signals and adjust duty cycle of the pixel clock signals; and a number (N) of gate drivers, configured to receive the pixel clock signal of an adjusted duty cycle and a preset gate turn-on voltage provided by an external signal source, and calculate the actual gate turn-on voltage provided to the gate lines based on the pixel clock signal of the adjusted duty cycle and the preset gate turn-on voltage, wherein the duty cycle provided by the signal controller to the gate drivers, from the first to the Nth, increases linearly when the gate drivers, from the first to the Nth, are arranged along the direction away from the signal controller, thus the actual gate turn-on voltage calculated by each gate driver based on the corresponding pixel clock signal and the base gate turn-on signal is the same, wherein each gate driver comprises:

a detecting unit, configured to detect the duration of the high level of the received pixel clock signal and the interval of the high level of two neighboring pixel clock signals;

a calculating unit, configured to calculate the actual gate turn-on voltage based on the duration of the high level of the received pixel clock signal, time interval, the preset gate turn-on voltage and a time limit of the duration of the high level of the pixel clock signal;

a second output unit, configured to output the calculated actual gate turn-on voltage to m corresponding gate lines;

wherein the calculating unit calculates the actual gate turn-on voltage based on the duration of the high level of the received pixel clock signal, time interval, the preset gate turn-on voltage and a time limit of the duration of the high level of the pixel clock signal by the following Formula 1, $$VGH=K\times(Tr-T0)/\Delta t+V0, \quad \text{[Formula 1]}$$

where VGH stands for the actual gate turn-on voltage, Tr stands for the duration of the high level of the received pixel clock signal, T0 stands for the time limit of the duration of the high level of the pixel clock signal, Δt stands for time interval, and V0 stands for the preset gate turn-on voltage.

2. The liquid crystal penal driver of claim 1, wherein each gate driver provides the calculated actual gate turn-on voltage to m gate lines;

the signal controller comprises:

a generating unit, configured to generate pixel clock signals;

a counting unit, configured to generate a counting signal when the number counted is a natural multiple of m;

a duty cycle adjusting unit, configured to receive the counting signal and adjust the duty cycle of the pixel clock signal accordingly;

a first output unit, configured to output the pixel clock signal of an adjusted duty cycle to the corresponding gate driver.

3. A method for driving drivers of a liquid crystal display, the drivers comprising a signal controller and a number (N) of gate drivers, the method comprising:

generating pixel clock signals with the signal controller and adjusting the duty cycle of the pixel clock signals;

calculating an actual gate turn-on voltage provided to gate lines with the gate drivers based on a pixel clock signal of an adjusted duty cycle and a preset gate turn-on voltage provided by an external signal source, wherein the duty cycle provided by the signal controller to the gate drivers, from the first to the Nth, increases linearly when the gate drivers, from the first to the Nth, are arranged along the direction away from the signal controller, thus the actual gate turn-on voltage calculated by each gate driver based on the corresponding pixel clock signal and the base gate turn-on signal is the same, wherein each gate driver comprises a detecting unit, a calculating unit, and a second output unit;

a step of calculating the actual gate turn-on voltage provided to gate lines with the gate drivers based on the pixel clock signal of the adjusted duty cycle and the preset gate turn-on voltage provided by the external signal source, comprises:

detecting, with the detecting unit, the duration of the high level of the received pixel clock signal and the interval of the high level of two neighboring pixel clock signals;

calculating, with the calculating unit, the actual gate turn-on voltage based on the duration of the high level of the received pixel clock signal, the time interval, the preset gate turn-on voltage and a time limit of the duration of the high level of the pixel clock signal;

outputting, with the second output unit, the calculated actual gate turn-on voltage to the m corresponding gate lines, wherein the calculating unit calculates the actual gate turn-on voltage based on the duration of the high level of the received pixel clock signal, time interval, the preset gate turn-on voltage and a time limit of the duration of the high level of the pixel clock signal by the following Formula 1, $$VGH=Kx(Tr-T0)/\Delta t+V0, \quad \text{[Formula 1]}$$

where VGH stands for the actual gate turn-on voltage, Tr stands for the duration of the high level of the received pixel clock signal, T0 stands for the time limit of the duration of the high level of the pixel clock signal, Δt stands for time interval, and V0 stands for the preset gate turn-on voltage.

4. The method of claim 3, wherein each gate driver provides the calculated actual gate turn-on voltage to m gate lines;

the signal controller comprises a generating unit, a counting unit, a duty cycle adjusting unit, and a first output unit;

wherein a step of generating pixel clock signals with the signal controller and adjusting the duty cycle of the pixel clock signals further comprises:

generating pixel clock signals with the generating unit;

generating, with the counting unit, a counting signal when the number counted is a natural multiple of m;

receiving the counting signal and adjusting the duty cycle of the pixel clock signal with the duty cycle adjusting unit;

outputting the pixel clock signal of an adjusted duty cycle to the corresponding gate driver with the first output unit.

* * * * *